United States Patent [19]

Wilhoit

[11] 4,347,901

[45] Sep. 7, 1982

[54] FIRE EXTINGUISHING SYSTEM FOR AIRCRAFT

[76] Inventor: George D. Wilhoit, 4421 Meade Ave., Fort Myers, Fla. 33901

[21] Appl. No.: 232,740

[22] Filed: Feb. 9, 1981

Related U.S. Application Data

[63] Continuation-in-part of Ser. No. 30,516, Apr. 16, 1979, Pat. No. 4,253,527.

[51] Int. Cl.[3] ..... A62C 35/12

[52] U.S. Cl. ..... 169/62; 169/57; 49/1

[58] Field of Search ..... 169/62, 56, 54, 57, 169/59, 60, 16, 19, 42; 239/171, DIG. 15; 49/1, 3, 4, 7, 31; 244/4 R

[56] References Cited

U.S. PATENT DOCUMENTS 1,575,126 3/1926 Peterman ..... 49/3

2,566,235 8/1951 Mathisen ..... 169/62

*Primary Examiner*—Joseph J. Rolla

*Assistant Examiner*—Kenneth Noland

*Attorney, Agent, or Firm*—Alfred E. Wilson

[57] ABSTRACT

A heat responsive fire extinguishing system is disclosed which includes a delivery tube, supported relative to and about the ceiling of a passenger compartment, for example, of an aircraft or other vehicle such as a boat. The delivery tube includes a plurality of spaced apart normally plugged openings directed at all areas within the compartment, the plugs being formed of a suitable material having relatively low fushion points, and wherein a flexible tensioned trigger line sensor operable by the existence of an above normal ambient temperature to, first, actuate an electric switch to permit the oxygen masks above the aircraft seats to drop and, second, to operate a time delay switch by means of the opening of the oxygen mask compartment door or otherwise to permit the positioning of the masks relative to the passengers faces, prior to the opening of a valve to direct a flow of a suitable pressurized fire extinguishing material into the delivery tube, wherein the plugs, exposed to the above normal ambient temperature, will be softened and blown out of the tube holes by the pressure forces of the fire extinguishing material in the tubes, to discharge the material outwardly through the holes to supress or extinguish any surrounding flames.

7 Claims, 2 Drawing Figures

FIRE EXTINGUISHING SYSTEM FOR AIRCRAFT

This is a continuation-in-part of my copending Application, entitled Heat Responsive Fire Extinguishing System, Ser. No. 030,516 filed Apr. 16, 1979 now U.S. Pat. No. 4,253,527.

BACKGROUND OF THE INVENTION

The present invention pertains to a fire extinguishing or suppression system for aircraft and other vehicles having closed cabins, and which is responsive to a predetermined degree of temperature rise due to a fire in the vicinity of a sensor means, to cause a discharge of a suitable pressurized fire extinguishing or suppression material, such as Halon, in the direction of the fire.

Therefore, one of the principal objects of the present invention is to provide a fire extinguishing or suppression system for aircraft including a perforated delivery tube, fixed relative to and about the ceiling of an aircraft or other cabin, and means to sense an unusual rise in temperature in any area adjacent thereto to cause the oxygen masks, positioned above the respective passenger seats, to drop downwardly, and, after a predetermined time delay period to open a valve means to a source of supply of a suitable pressurized fire extinguishing material, such as Halon, thereby permitting the material to flow into the delivery tube.

Another object of the invention is to provide the tube with plugs for the perforations, the plugs having relatively low temperature fusion points, whereby they are softened and blown-out when exposed to the pressure forces of the fire extinguishing material permitting the fire extinguishing material to be discharged into the area of the fire.

DESCRIPTION OF A PREFERRED EMBODIMENT

Figure 1:
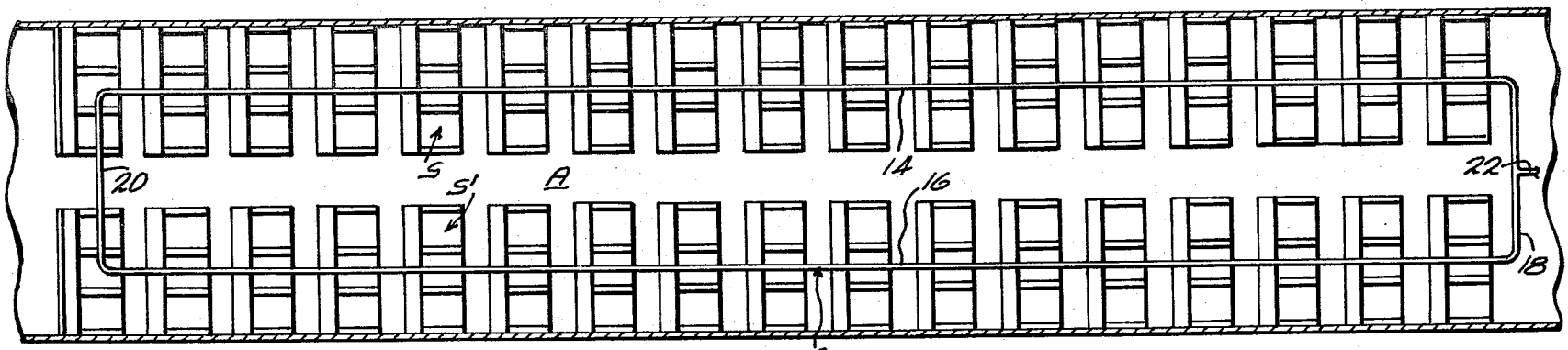
FIG. 1 is a generally schematic plan view of a typical passenger compartment of a commercial aircraft or other vehicle having a closed cabin, and illustrating the position of the fire extinguisher or suppression delivery tube relative thereto.

With reference to the drawings, and particularly to FIG. 1, a typical passenger compartment 10 of a commercial aircraft includes for example two side rows of three seats each S and S' separated by an aisle A. The position of a fire extinguisher delivery tube 12 is illustrated relative to the rows of seats, however, the tube 12 is fixed by any desired conventional means relative to the compartment ceiling.

In a preferred form, tube 12 is generally of an elongated rectangular configuration, including a pair of parallel side runs 14 and 16, interconnected by front and rear end portions 18 and 20. An inlet tube portion 22, from a source of supply of an appropriate fire suppressing or extinguishing material, such as Halon, is illustrated in open connection to the front tube portion 18.

Figure 2:
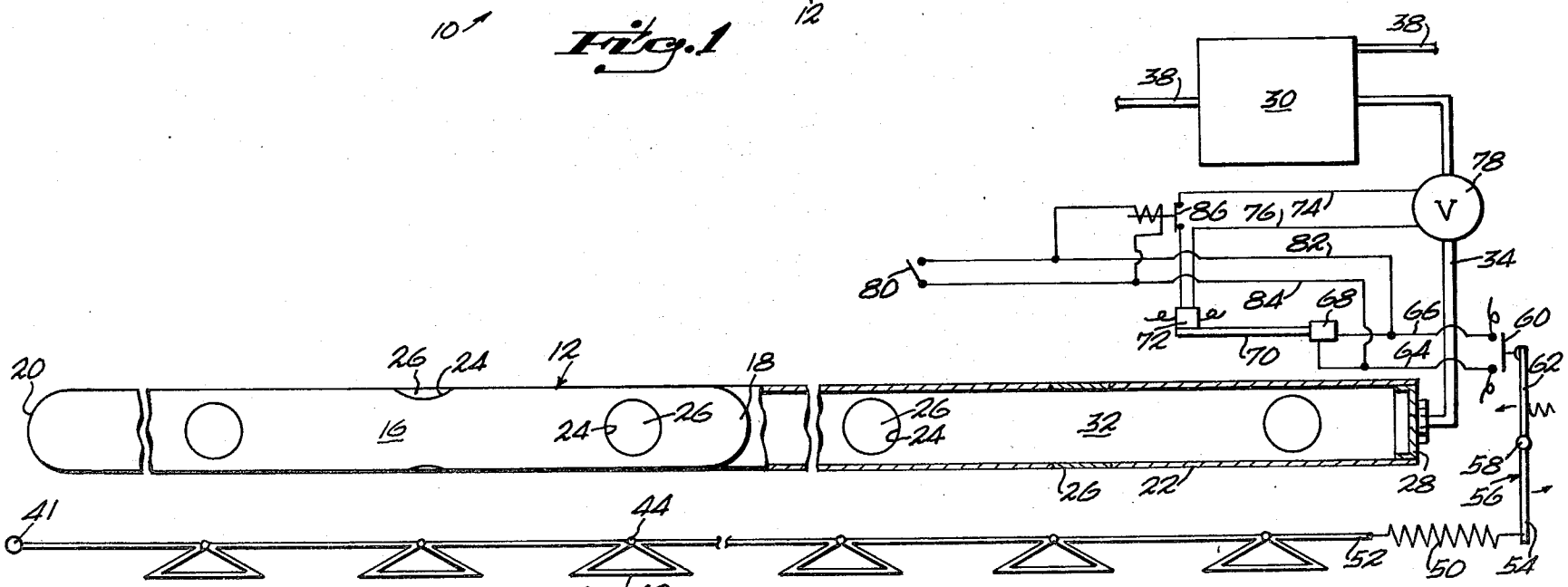
FIG. 2 is a diagrammatic view of the fire extinguishing system of the present invention.

With reference to FIG. 2, the delivery tube 12 is substantially enlarged with portions thereof broken away with a plurality of spaced apart perforations 24, along the lengths of the various portions thereof, normally closed by plugs 26, formed of a suitable material, such as a thermoplastic, having an appropriate relatively low fusion point.

As above described, the delivery tube 12 defines a circuit about the ceiling of compartment 10, and includes an inlet portion 22 which is capped as at 28. A source of supply 30 of a suitable fire extinguishing material is connected to the interior chamber 32 of tube 12 by a conduit 34 which opens through the capped end 28 of the inlet tube portion 22. Additional conduits from the source of supply 30, such as 38, may extend to delivery tubes in large multi-cabin airliners.

A heat sensor means 40, as disclosed in the above identified Parent Application, includes a fixed first end 41 and a plurality of spaced apart loops 42 along its length, each loop being fixed in a closed condition as at 44 by a material having a low fusion point, such as solder, so that exposure to an unusually high temperature will cause one or more loops 42 to open, releasing the tension on a tension spring 50 connecting between a second end 52 of sensor 40 and a first arm 54 of a lever 56 which is centrally pivoted at 58.

An electric contact 60, fixed to a second arm 62, of lever 56 completes an electric circuit across conductors 54, 56 to means, such as a solenoid operated latch 68, to unlatch a cover door such as 70, to an oxygen mask compartment (not shown) to permit the mask to fall downwardly therefrom in a conventional manner. A time delay switch 72 is operated by the opening of door 70 to close a circuit between conductors 74, 76 to open a valve 78 in conduit 34 to permit the fire extinguishing material from the source 30 to pass through conduit 34 into the delivery tube 12.

Conventional manual operation of the oxygen mask door 70 is provided by a switch 80, connected by conductors 82, 84 to conductors 64, 66. A normally closed solenoid switch 86 in conductor 74 is simultaneously operated to an open position to maintain valve 78 in a closed position to prevent passage of the fire extinguishing material from the source 30 to the delivery tube 12 when the manual switch 80 is operated.

It will be understood that in large vehicles such as aircraft wherein the passenger compartment are long and narrow, the aircraft may be formed of several sections connected together in end to end relation. In such aircraft wherein the separate sections are subject to being disjointed in the event of a crash, it is desirable to position a separately operable fire suppression system in each section so that in the event of such separation in the event of a crash the passengers in each section will be protected.

It will be obvious that the various modifications of the sensor means 40 and delivery tube 12 as disclosed in the aforementioned Parent Application are equally applicable to the above described fire extinguishing system for aircraft.

While a preferred form of the present invention has been herein described, it will be obvious to those skilled in the art that various changes and modifications can be made therein without departing from the true spirit of the invention as defined in the appended claims.

I claim:

1. A fire suppression system for vehicles having closed cabins with oxygen masks superposed above passenger seats comprising, a pressurized source of an appropriate fire extinguishing material, delivery means for said material supported relative to and about the general length and width of the ceiling of the vehicle compartment, means interconnecting said source to said delivery means including a normally closed valve means; heat responsive sensor means extending about the compartment relative to said delivery means to actuate said fire suppression system, a first normally open electric switch means in a first electric circuit, interconnected between said heat sensor and each existing oxygen mask compartment door in a vehicle in a manner so as to close said first switch permitting the opening of the doors and the automatic discharge of said oxygen masks therein in response to an overheated condition of said heat sensor; a second electric circuit connecting between said valve and a normally open time delay switch which is closed to open said valve after a predetermined time delay period in response to the opening of any one of said doors, to permit a flow of said fire extinguishing material from said source through said interconnection means and valve, and into said delivery means; a plurality of perforations about said delivery means to permit the discharge of said fire extinguishing material through said perforations when the system is actuated.

2. The system as defined in claim 1 wherein the vehicle is an aircraft.

3. The invention defined in claim 1 wherein the perforations in the delivery means are normally closed by heat responsive material which softens in response to a relatively high ambient temperature and are blown out under the influence of pressure forces of said fire extinguishing material to permit the discharge thereof through the perforations.

4. The system as defined in claim 1 including a third electric circuit with a second normally open switch, connected to said first circuit in a manner so as to permit manual actuation of the oxygen mask compartment doors to an open position by the closing of said second switch.

5. The system as defined in claim 4 including a fourth electric circuit including a solenoid operated switch in a normally closed relation in said second circuit, for operation to an open position when said second normally open switch is closed.

6. The system as defined in claim 1 wherein said delivery means comprises a tubular assembly defining a generally elongated rectangular configuration with a tubular inlet portion connected between one end span thereof and said interconnecting means.

7. The system as defined in claim 6 wherein said fire extinguishing material is Halon.

* * * * *